US007891841B2

(12) United States Patent
Levine

(10) Patent No.: US 7,891,841 B2
(45) Date of Patent: Feb. 22, 2011

(54) LIGHTING DEVICE

(76) Inventor: Jonathan E. Levine, 419 Park Ave. South, Suite 505, New York, NY (US) 10016

( * ) Notice: Subject to any disclaimer, the term of this patent is extended or adjusted under 35 U.S.C. 154(b) by 282 days.

(21) Appl. No.: 12/356,753

(22) Filed: Jan. 21, 2009

(65) Prior Publication Data

US 2010/0182781 A1 Jul. 22, 2010

(51) Int. Cl.
*F21L 4/02* (2006.01)

(52) U.S. Cl. ..... 362/249.07; 362/249.11; 362/249.02; 362/222; 362/232; 362/236

(58) Field of Classification Search ..... 362/249.02, 362/249.07, 249.1, 249.11, 35, 164–170, 362/184, 228, 232, 236
See application file for complete search history.

(56) References Cited

U.S. PATENT DOCUMENTS

| | | | |
|---|---|---|---|
| 4,528,618 | A | 7/1985 | Bitsch |
| 4,613,847 | A | 9/1986 | Scolari et al. |
| 4,751,627 | A | 6/1988 | Usher |
| D300,876 | S | 4/1989 | Sakai |
| D302,325 | S | 7/1989 | Charet et al. |
| 4,943,900 | A | 7/1990 | Gärtner |
| D320,863 | S | 10/1991 | Macaluso |
| D327,334 | S | 6/1992 | Parker |
| 5,353,208 | A | 10/1994 | Moore |
| D353,907 | S | 12/1994 | Doria |
| D357,993 | S | 5/1995 | Yuen |
| D366,337 | S | 1/1996 | Yuen |
| D377,988 | S | 2/1997 | Brain et al. |
| 5,765,939 | A | 6/1998 | Tanner, Jr. |
| D397,478 | S | 8/1998 | Booty, Jr. |
| 5,911,493 | A | 6/1999 | Walker et al. |
| D438,313 | S | 2/2001 | Tam |
| 6,186,635 | B1 | 2/2001 | Peterson et al. |
| 6,340,233 | B1 | 1/2002 | Shieh |
| 6,390,652 | B1 | 5/2002 | Echito |
| 6,454,431 | B1 | 9/2002 | Grossman et al. |
| 6,588,920 | B2 | 7/2003 | Agro |
| 6,619,813 | B1 | 9/2003 | Schnell |
| 6,641,283 | B1 | 11/2003 | Bohler |
| D498,864 | S | 11/2004 | Lee |
| D506,560 | S | 6/2005 | Oas |

(Continued)

OTHER PUBLICATIONS

Notice of Allowance for U.S. Appl. No. 29/331,153, Aug. 24, 2009 (7 pages).

*Primary Examiner*—Anabel M Ton
(74) *Attorney, Agent, or Firm*—Theodore W. Baker

(57) ABSTRACT

A lighting device is disclosed. The lighting device can be compact and can have a major surface configured to be attached to a substantially flat mounting surface. Within the lighting device, a light bar frame can be rotatable relative to a mounting plate around an axis substantially perpendicular to the major surface. Three or more rotatable light bars can be positioned within the light bar frame. The light bars can include lighting elements (e.g., light-emitting diodes) and can be positioned within the light bar frame such that their rotational axes are coplanar. The rotational axes of the light bars also can be substantially perpendicular to the axis around which the light bar frame rotates relative to the mounting plate. Furthermore, the rotational axes of the light bars can form three or more sides of a polygon (e.g. a triangle).

20 Claims, 10 Drawing Sheets

U.S. PATENT DOCUMENTS

| | | | | |
|---|---|---|---|---|
| D512,170 | S | 11/2005 | Canino et al. | |
| 7,270,443 | B2 | 9/2007 | Kurtz et al. | |
| D561,925 | S | 2/2008 | Levine | |
| D563,013 | S | 2/2008 | Levine | |
| D563,014 | S | 2/2008 | Levine | |
| D563,582 | S | 3/2008 | Levine | |
| D564,118 | S | 3/2008 | Wu | |
| D570,023 | S | 5/2008 | Lee | |
| D576,334 | S | 9/2008 | Levine | |
| D576,338 | S | 9/2008 | Levine | |
| D578,246 | S | 10/2008 | Levine | |
| D578,703 | S | 10/2008 | Levine | |
| D580,573 | S | 11/2008 | Leslie et al. | |
| D580,575 | S | 11/2008 | Shiu | |
| D581,077 | S | 11/2008 | Levine | |
| D581,569 | S | 11/2008 | Levine | |
| D581,570 | S | 11/2008 | Levine | |
| D581,571 | S | 11/2008 | Levine | |
| D581,572 | S | 11/2008 | Levine | |
| D582,601 | S | 12/2008 | Levine | |
| D585,152 | S | 1/2009 | Levine | |
| D585,578 | S | 1/2009 | Levine | |
| D603,550 | S | 11/2009 | Levine | |
| 7,618,150 | B2 * | 11/2009 | Chien | 362/35 |
| 7,834,901 | B2 * | 11/2010 | Ueno | 347/243 |
| 2005/0174751 | A1 | 8/2005 | Liao | |
| 2005/0270801 | A1 | 12/2005 | Torgerson | |
| 2006/0256584 | A1 | 11/2006 | Paoluccio | |
| 2007/0097689 | A1 | 5/2007 | Barausky et al. | |
| 2008/0112169 | A1 | 5/2008 | Cunius | |
| 2009/0154151 | A1 * | 6/2009 | Levine | 362/184 |

* cited by examiner

LIGHTING DEVICE

FIELD

This disclosure concerns lighting devices, such as compact, battery-powered lighting devices having one or more maneuverable light bars connected to a frame.

BACKGROUND

Compact lighting devices have become popular consumer products. These devices can be used, for example, to conveniently provide supplemental lighting to small areas lacking sufficient overhead lighting. In one example of a common application, a compact lighting device is mounted to the underside of a kitchen cabinet to provide lighting for a countertop. Compact lighting devices also can be used to provide accent lighting and to provide lighting to areas that may have no other light source, such as closets and storage units.

One example of a known compact lighting device is disclosed in U.S. Pat. No. 6,641,283 (Bohler). Bohler describes a compact lighting device including light-emitting diodes (LEDs) and an optical assembly that "focuses and disperses the LED output to a desired light contour" (abstract). The compact lighting device of Bohler can be powered by a battery system (column 3, lines 13-15). As another example, U.S. Pat. No. 6,979,107 (Benensohn) discloses a hard-wired compact lighting device including a "reflector [that] defines a dished cavity" and a "light transmissive cover" positioned over the reflector (abstract and FIG. 1).

SUMMARY

Disclosed herein are embodiments of a lighting device, such as a compact lighting device. The lighting device can include a mounting plate and a light bar frame rotatable relative to the mounting plate. Three or more rotatable light bars can be positioned within the light bar frame. The light bars can include lighting elements, such as light-emitting diodes. For example, each light bar can include two or more light-emitting diodes. A manual power switch and/or an automatic sensor (e.g. a light sensor or motion sensor) can be included to control activation of the lighting elements. A battery compartment can be positioned within the light bar frame as an exclusive or alternative power source for the lighting elements. In some embodiments with a battery compartment, the light bar frame is separable from the mounting plate to provide access to the battery compartment.

The mounting plate, or another portion of the lighting device, can define a major surface configured to be attached to a substantially flat mounting surface. The axis around which the light bar frame rotates relative to the mounting plate can be substantially perpendicular to the major surface. The rotational axes of the light bars can be substantially parallel to the major surface. The lighting device can have a cross section in a plane substantially parallel to the major surface that is substantially shaped as a polygon (e.g. a triangle) and the light bars can be positioned, respectively, along each side of the polygon. For example, the light bars each can extend over between about 40% and about 95% of the length of a side of the polygon.

The light bars can be positioned within the light bar frame such that their rotational axes are coplanar. The rotational axes of the light bars also can be substantially perpendicular to the axis around which the light bar frame rotates relative to the mounting plate. Furthermore, the rotational axes of the light bars can form the sides of a polygon (e.g. a triangle). In embodiments in which the light bars are elongated, the rotational axis of each light bar can be parallel to the length of each light bar.

DETAILED DESCRIPTION

Throughout this disclosure, the singular terms "a," "an," and "the" include plural referents unless the context clearly indicates otherwise. Similarly, the word "or" is intended to include "and" unless the context clearly indicates otherwise. As used herein the word "connected" does not exclude the presence of one or more intervening elements. Directional terms, such as "upper," "lower," "front," "back," "vertical," and "horizontal," are used herein to express and clarify the relationship between various elements. It should be understood that such terms do not denote absolute orientation (e.g., a "vertical" component can become horizontal by rotating the device).

Described herein are embodiments of a lighting device. Conventional lighting devices typically are fixed so that the direction of emitted light cannot be adjusted. In contrast, embodiments of the disclosed lighting device can include features that allow for adjustment of the direction of emitted light. This is useful for a variety of applications. For example, the angle of emitted light can be adjusted to focus light on a work area without moving the entire device. Moreover, if the device is mounted, the angle of emitted light can be adjusted without the need to remove and remount the device. The ability to adjust the angle of emitted light facilitates targeted accent lighting and a variety of other applications.

Figure 13:
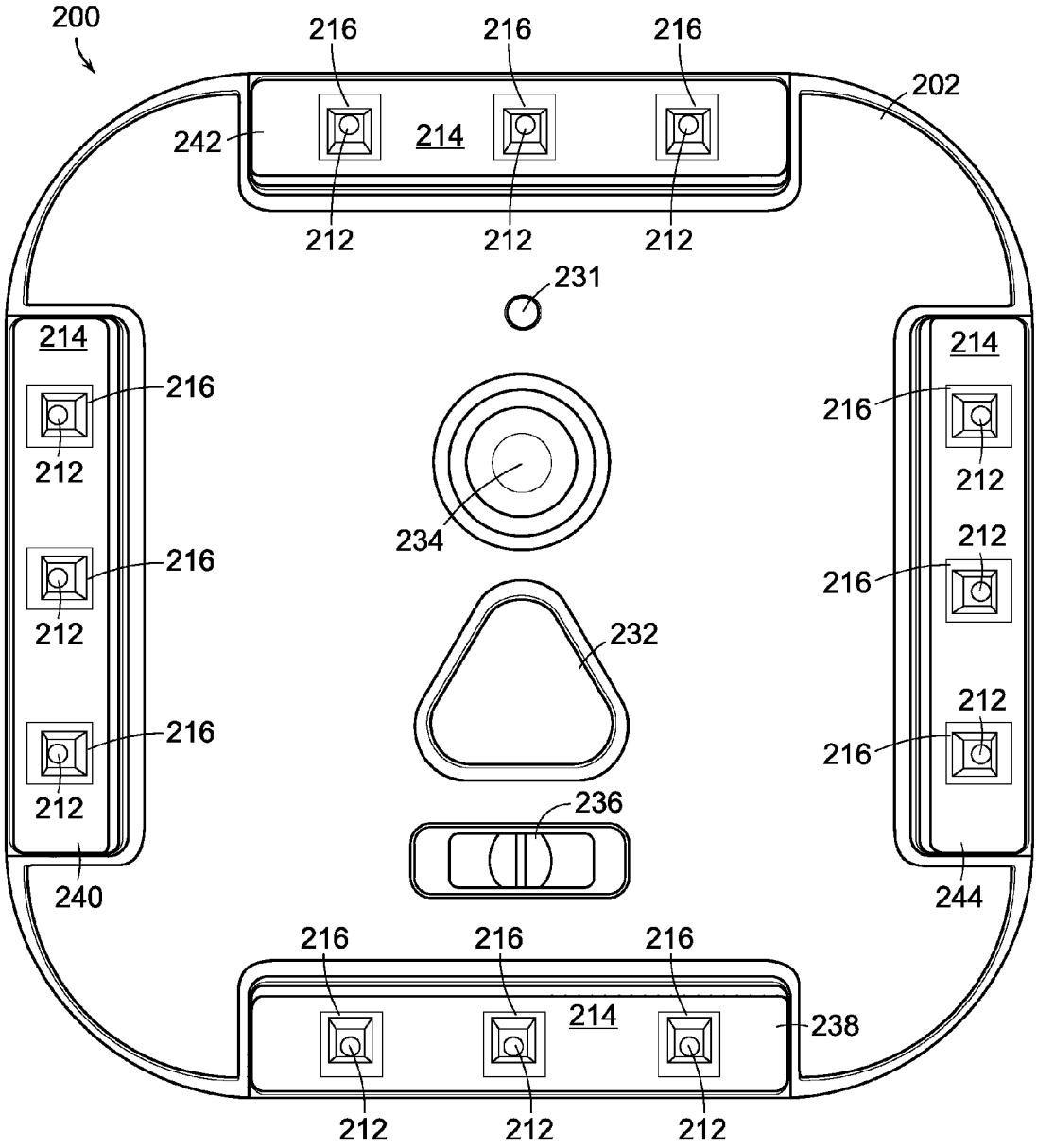
FIG. 13 is a top plan view of a second embodiment of the disclosed lighting device having four sides and four light bars.
Figure 14:
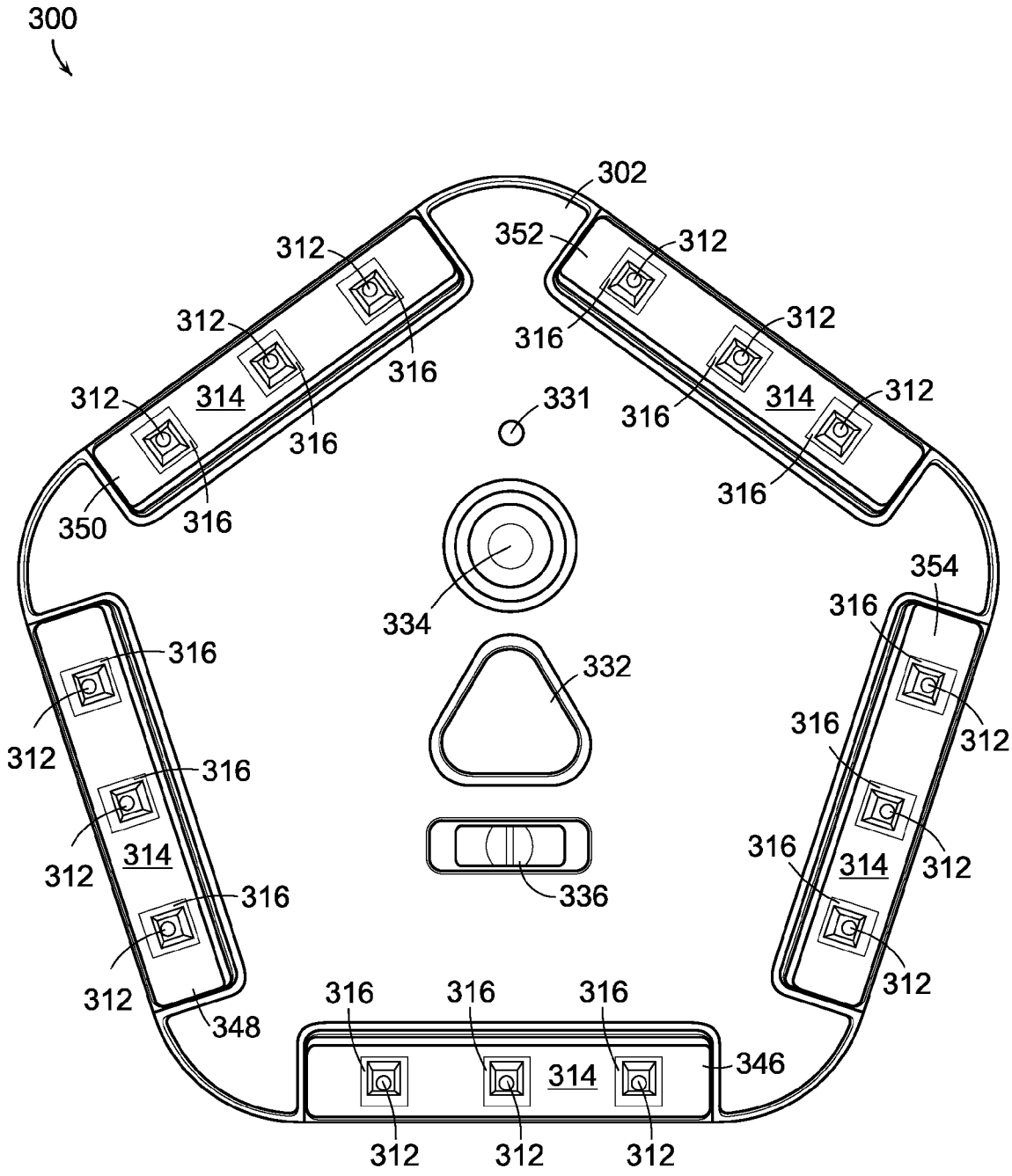
FIG. 14 is a top plan view of a third embodiment of the disclosed lighting device having five sides and five light bars.

FIGS. 1-12 illustrate a first embodiment of the disclosed lighting device. FIG. 13 illustrates a second embodiment of the disclosed lighting device. The first digit of each reference number shown in FIG. 13 is "2." The final two digits of the reference numbers shown in FIG. 13 are identical to the final two digits of the reference numbers shown in FIGS. 1-12 for similar or identical elements. FIG. 14 illustrates a third embodiment of the disclosed lighting device. The first digit of each reference number shown in FIG. 14 is "3." The final two digits of the reference numbers shown in FIG. 14 are identical to the final two digits of the reference numbers shown in FIGS. 1-12 for similar or identical elements.

As shown in FIGS. 1-12, the illustrated lighting device 100 includes a frame 102 rotatably connected to a mounting plate 104. The mounting plate 104 is configured for attachment to a substantially flat mounting surface, such as a wall or the underside of a kitchen cabinet. When the mounting plate 104 is attached to a mounting surface, the frame 102 becomes rotatable relative to the mounting surface. First, second, and third light bars 106, 108, 110 are positioned within the frame 102 and are rotatable relative to the frame. The first, second, and third light bars 106, 108, 110 each rotate around axes substantially perpendicular to the axis around which the frame 102 rotates relative to the mounting plate 104. The combination of rotation of the frame 102 relative to the mounting plate 104 and rotation of the first, second, and third light bars 106, 108, 110 relative to the frame allows for extensive adjustment of the direction of emitted light.

The frame 102 of the lighting device 100 is substantially shaped as a triangular prism. In other embodiments, the frames can have different shapes. For example, the frame 202 of the lighting device 200 shown in FIG. 13 is substantially shaped as a cuboid. The frame 302 of the lighting device 300 shown in FIG. 14 is substantially shaped as a hexagonal prism. Additional embodiments are possible with frames shaped as other three-dimensional polygons or as other three-dimensional non-polygon shapes (e.g., spheroids). The illustrated lighting devices 100, 200, 300 are all substantially symmetrical. Other embodiments can be either symmetrical or non-symmetrical.

The lighting device 100 shown in FIGS. 1-12 has a substantially triangular cross section in a plane substantially parallel to a major surface of the mounting plate 104. Other embodiments can have a cross section in a plane substantially parallel to a major surface of the mounting plate that is substantially shaped as another polygon or non-polygon. In embodiments with polygon-shaped cross sections, the light bars can be positioned, respectively, along sides of the polygon. Each light bar, for example, can extend over between about 30% and about 100% of the length of a side of the polygon, such as between about 40% and about 95% or between about 50% and about 90%.

The disclosed lighting device can be any size, but typically is compact. For example, embodiments of the lighting device can have an average width (substantially parallel to a major surface of the mounting plate) from about 2 centimeters to about 30 centimeters, such as from about 5 centimeters to about 20 centimeters or from about 8 centimeters to about 15 centimeters. Embodiments of the lighting device can have an average height (substantially perpendicular to a major surface of the mounting plate), for example, from about 1 centimeter to about 10 centimeters, such as from about 2 centimeters to about 8 centimeters or from about 3 centimeters to about 6 centimeters. The average-height-to-average-width ratio of the lighting device can be, for example, from about 0.1 to about 2, such as from about 0.2 to about 1 or from about 0.3 to about 0.6.

Figure 1:
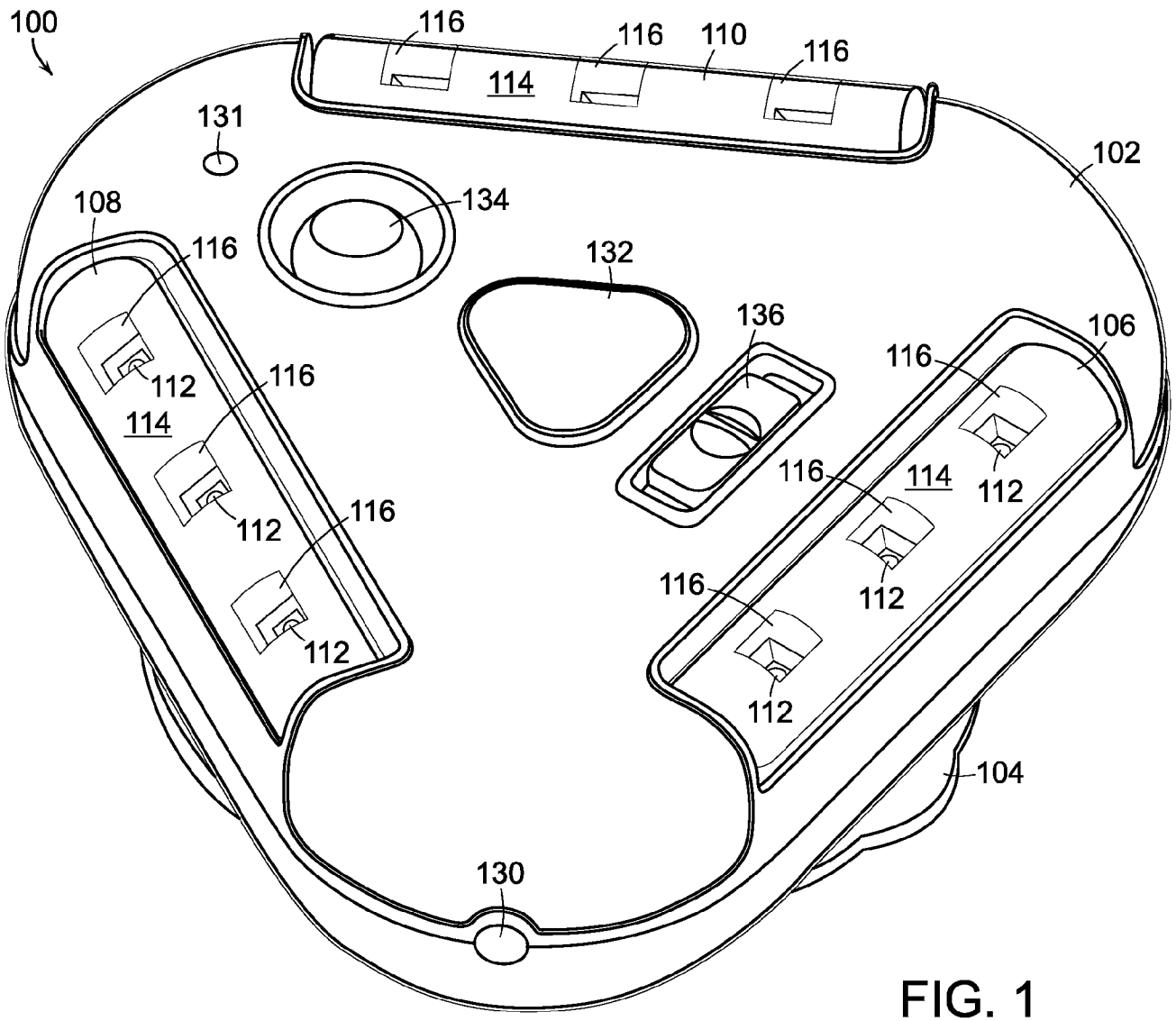
FIG. 1 is a perspective view of a first embodiment of the disclosed lighting device with the light bars rotated to positions approximately midway through their rotational ranges.

The first, second, and third light bars 106, 108, 110 in the lighting device 100 are cylindrical in shape. The light bars in other embodiments can have different shapes (e.g., triangular prism, spheroid, or cuboid), but typically are elongated with substantially straight lengths to facilitate rotation. As shown in FIG. 1, the first, second, and third light bars 106, 108, 110 are positioned with their lengths extending along the upper corners of the frame 102. Similarly, the lighting device 200 of FIG. 13 includes first, second, third, and fourth light bars 238, 240, 242, 244 positioned with their lengths extending along the upper corners of the frame 202. The lighting device 300 of FIG. 14 includes first, second, third, fourth, and fifth light bars 346, 348, 350, 352, 354 positioned with their lengths extending along the upper corners of the frame 302. Other embodiments can include light bars positioned near, but not directly along, the upper corners of the frame. As shown in FIG. 1, the first, second, and third light bars 106, 108, 110 in the lighting device 100 are inset within the frame 102 such that they do not project beyond adjacent surfaces of the frame. Other embodiments can include light bars that project beyond adjacent surfaces of the frame or are inset further into the frame. Positioning the light bars on or near substantially straight corners of the frame typically maximizes the range of space to which light can be directed.

The rotational axes of the first, second, and third light bars 106, 108, 110 of the lighting device 100 are coplanar and intersect to form a triangle. This triangle is dimensionally similar to the cross-sectional outline of the frame 102 in a plane parallel to a major surface of the mounting plate 104. The rotational axes of the first, second, third, and fourth light bars 238, 240, 242, 244 of the lighting device 200 of FIG. 13 and the first, second, third, fourth, and fifth light bars 346, 348, 350, 352, 354 of the lighting device 300 of FIG. 14 have similar relationships to the cross-sectional outlines of the frame 202 and the frame 302, respectively.

The first, second, and third light bars 106, 108, 110 of the lighting device 100 each include three lighting elements 112 positioned below a substantially transparent window 114. The lighting elements 112 are arranged in rows substantially parallel to the lengths of the first, second, and third light bars 106, 108, 110. In other embodiments, the light bars can include one, two, four, five, six, seven, eight, nine, ten, or a greater number of lighting elements. In embodiments that include multiple lighting elements, the lighting elements can be arranged in a variety of configurations. For example, the lighting elements can be arranged in multiple rows that are substantially parallel to the lengths of the light bars or in one or more rows that are substantially perpendicular to the lengths of the light bars. The lighting elements also can be arranged, for example, in clusters or in a staggered pattern.

In the illustrated lighting device 100, the lighting elements 112 are white light-emitting diodes. In other embodiments, the lighting elements can be incandescent, fluorescent, halogen, xenon, neon, or some other commercially available lighting type. Light-emitting diodes are particularly well suited for use in disclosed embodiments due to their compact size, low power demand, low heat output, long life, and high durability. Instead of white light-emitting diodes, other embodiments can include light-emitting diodes of another color, such as red, orange, yellow, green, or blue.

The windows 114 extend along the majority of the lengths of one side of the first, second, and third light bars 106, 108, 110. The windows 114 of the illustrated lighting device 100 are made of clear plastic. Other embodiments can have windows made of glass or another substantially optically transmissive material. Opaque portions of the lighting device 100 are also made of plastic. In other embodiments, the opaque portions can be made of metal, resin composite, or another material with suitable strength characteristics. The lengths of the windows in embodiments of the disclosed lighting device can be, for example, between about 20% and about 100% of the lengths of the corresponding light bars, such as between about 50% and about 100% or between about 60% and about 90%. The majority of the inside surfaces of the windows 114 of the lighting device 100 are coated to give them a slightly frosted appearance. The windows 114 also include uncoated regions 116 directly above each of the individual lighting elements 112. To further promote the transmission of light, the lighting elements 112 are mounted on reflective backings (not shown).

Figure 8:
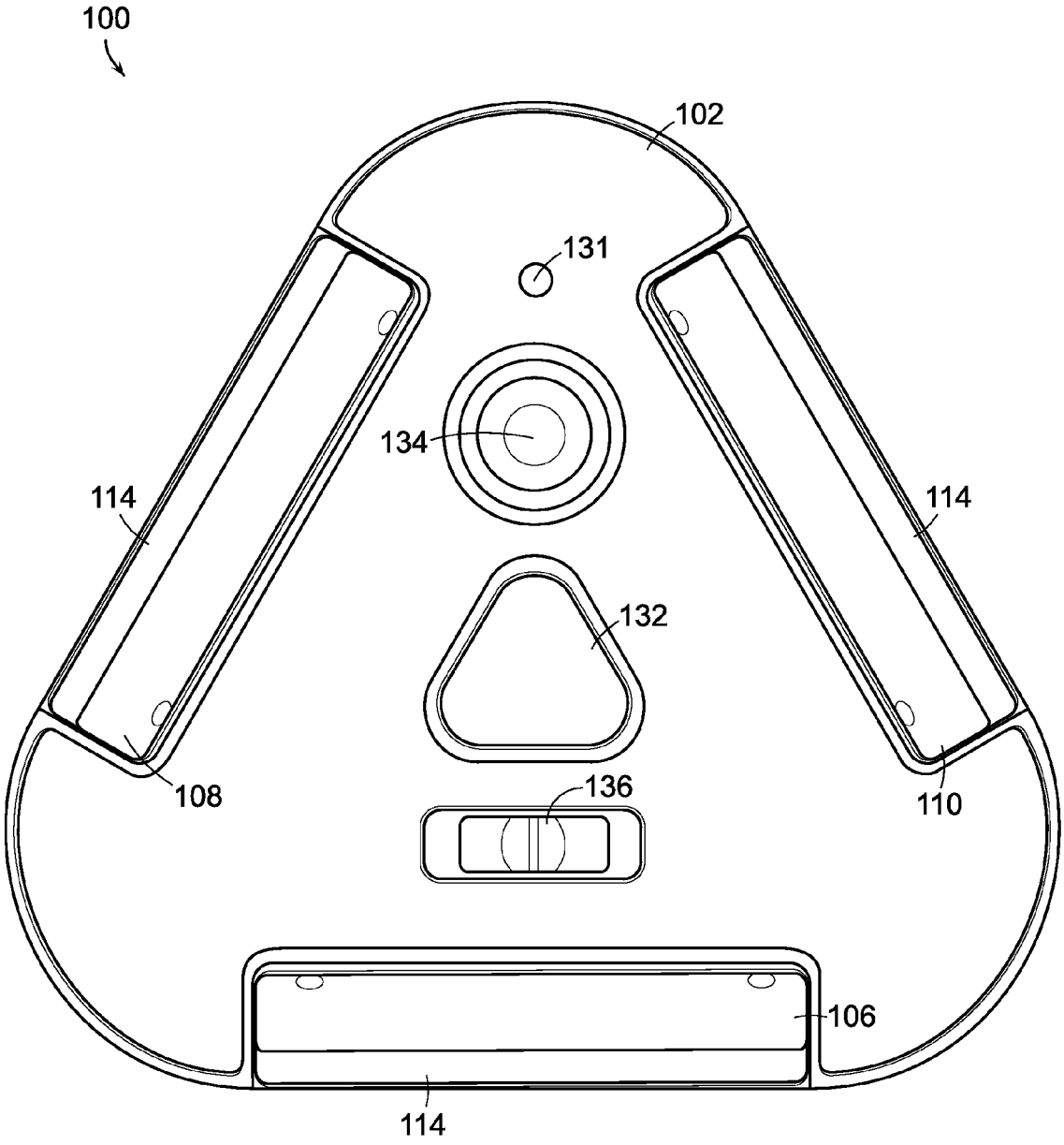
FIG. 8 is a top plan view of the lighting device of FIG. 1 with the light bars fully rotated in a first direction.
Figure 9:
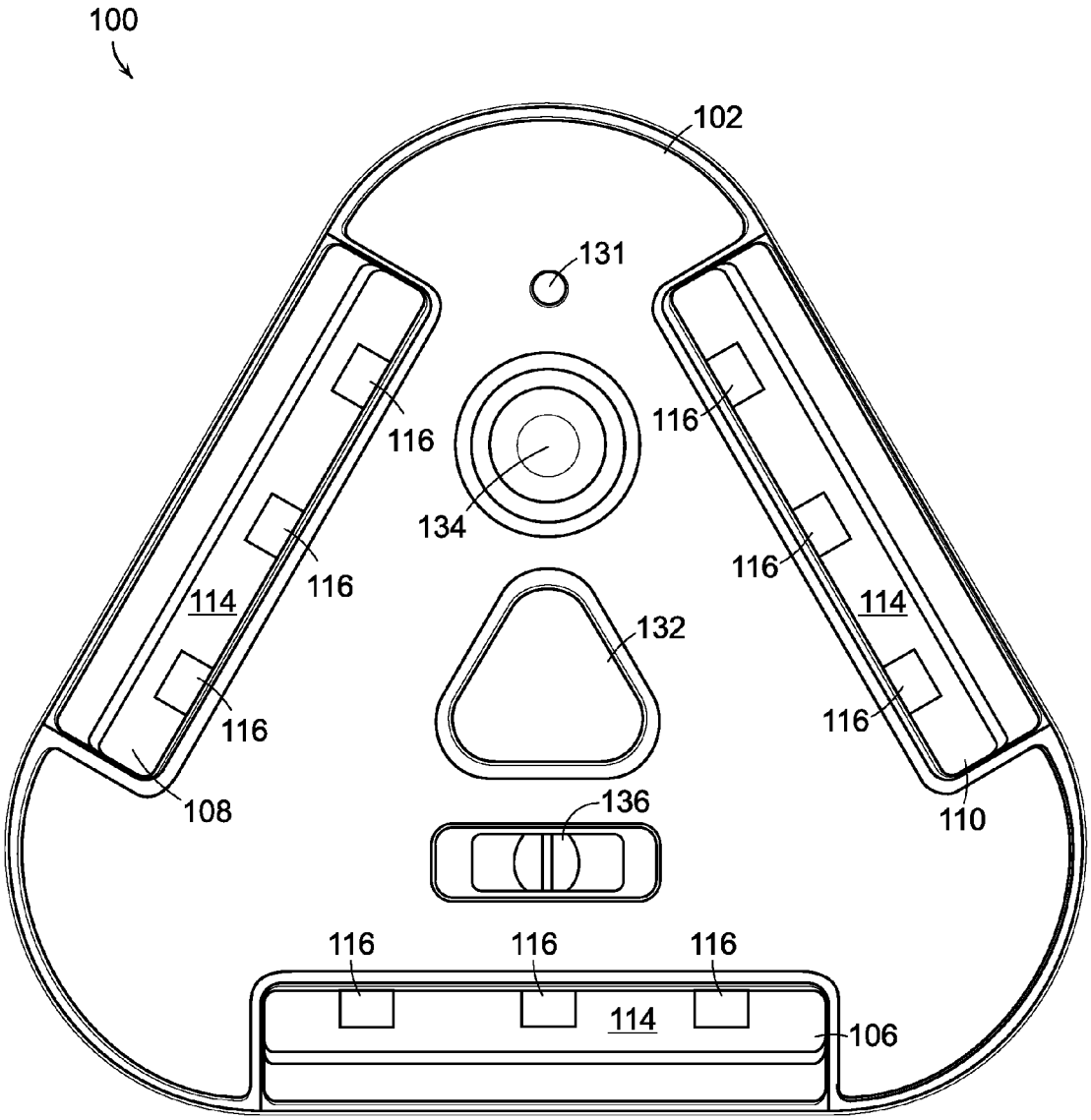
FIG. 9 is a top plan view of the lighting device of FIG. 1 with the light bars fully rotated in a second direction.

The first, second, and third light bars 106, 108, 110 in the lighting device 100 each are rotatable through a range of about 180° relative to the frame 102. FIGS. 8 and 9, respectively, show the lighting device 100 with the first, second, and third light bars 106, 108, 110 rotated to opposite extremes of their rotational ranges. Further rotation is physically blocked by interaction between internal projections (not shown) on each end of the first, second, and third light bars 106, 108, 110 and internal stops (not shown) within the frame 102. Restricting rotation helps to prevent wires (not shown) extending from the frame 102 to the lighting elements 112 from becoming tangled or breaking from excess tension. Other embodiments can include light bars that rotate over a greater or smaller range or over an unrestricted range.

The first, second, and third light bars 106, 108, 110 in the lighting device 100 typically stay in position after partial rotation. This occurs because there is a small amount of friction within the joints connecting the first, second, and third light bars 106, 108, 110 to the frame 102. In some embodiments, the light bars are rotatable between defined positions. For example, in such embodiments, the light bars can include nubs that slide between notches in the frame during rotation, with each of the notches corresponding to one position.

Figure 2:
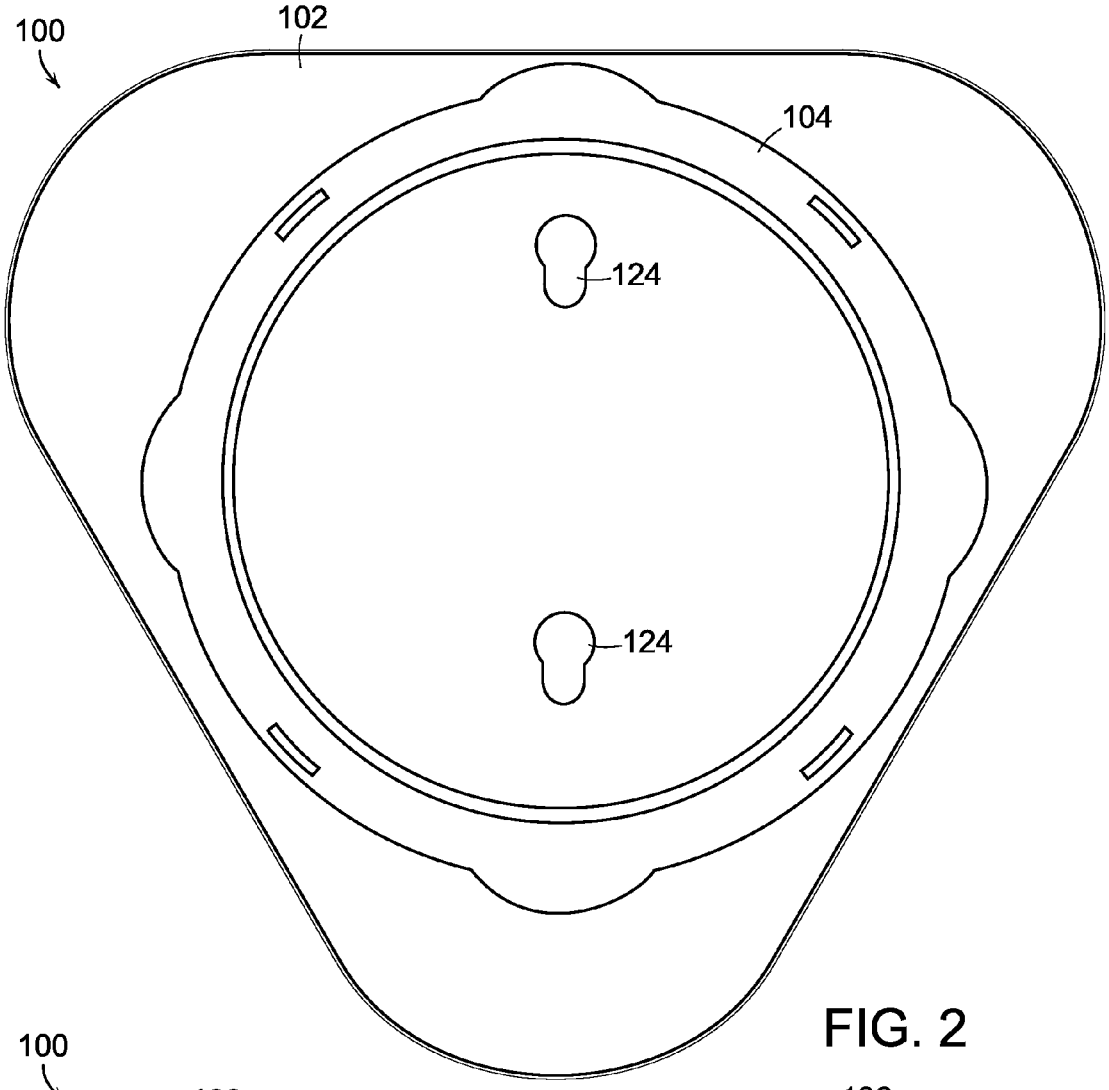
FIG. 2 is a bottom plan view of the lighting device of FIG. 1.
Figure 3:
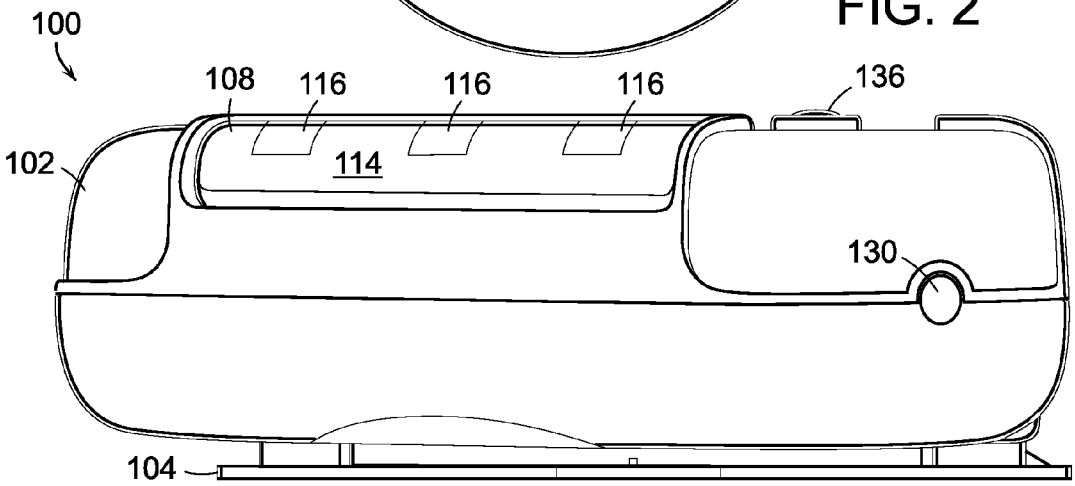
FIG. 3 is a first side profile view of the lighting device of FIG. 1.
Figure 4:
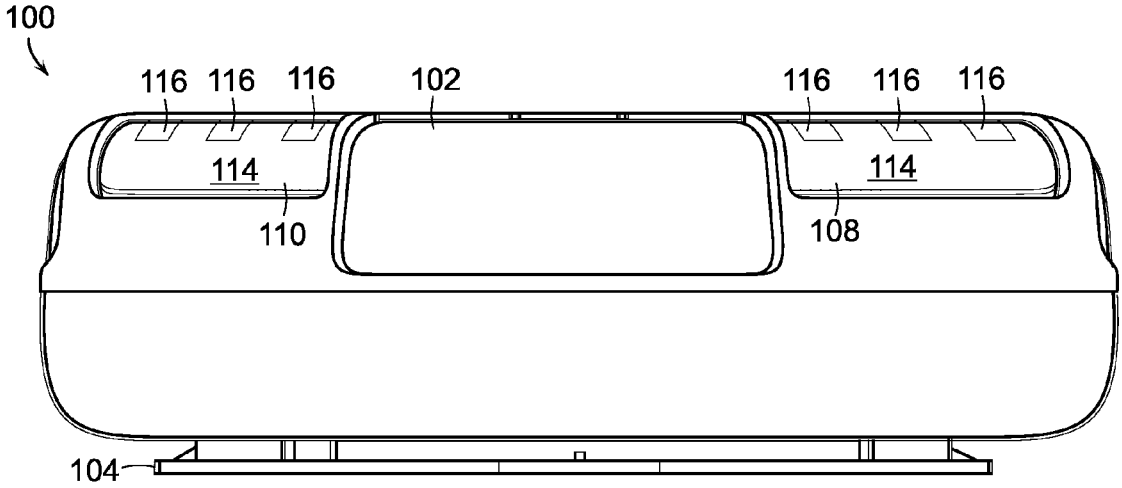
FIG. 4 is a back profile view of the lighting device of FIG. 1.
Figure 5:
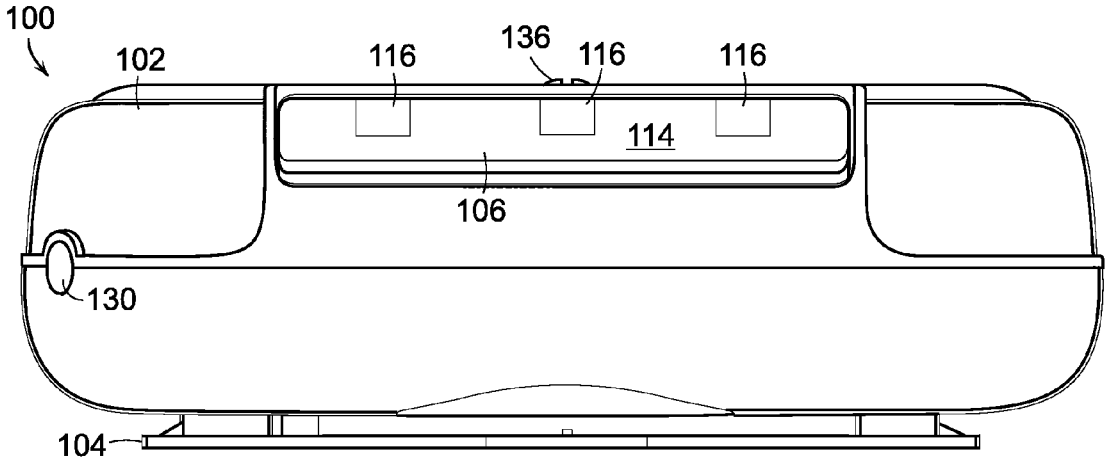
FIG. 5 is a front profile view of the lighting device of FIG. 1.
Figure 6:
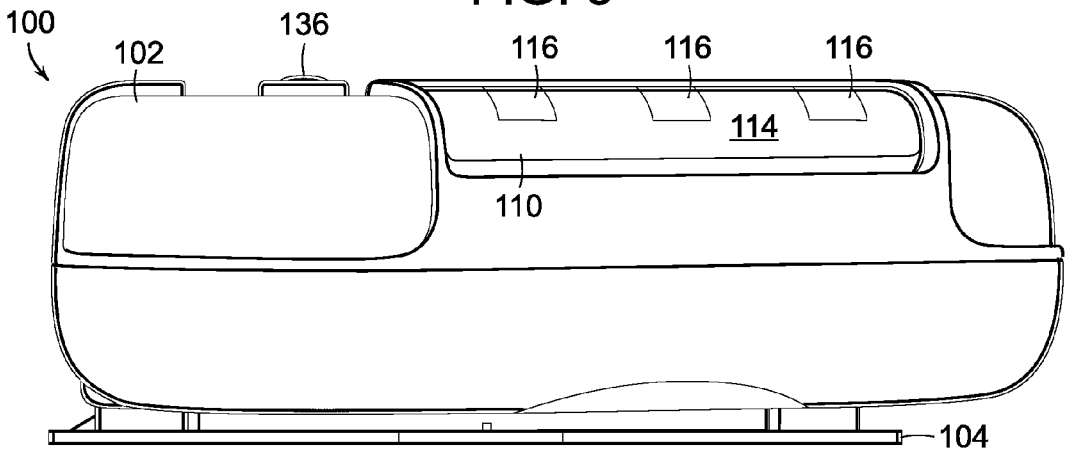
FIG. 6 is a second side profile view of the lighting device of FIG. 1.
Figure 7:
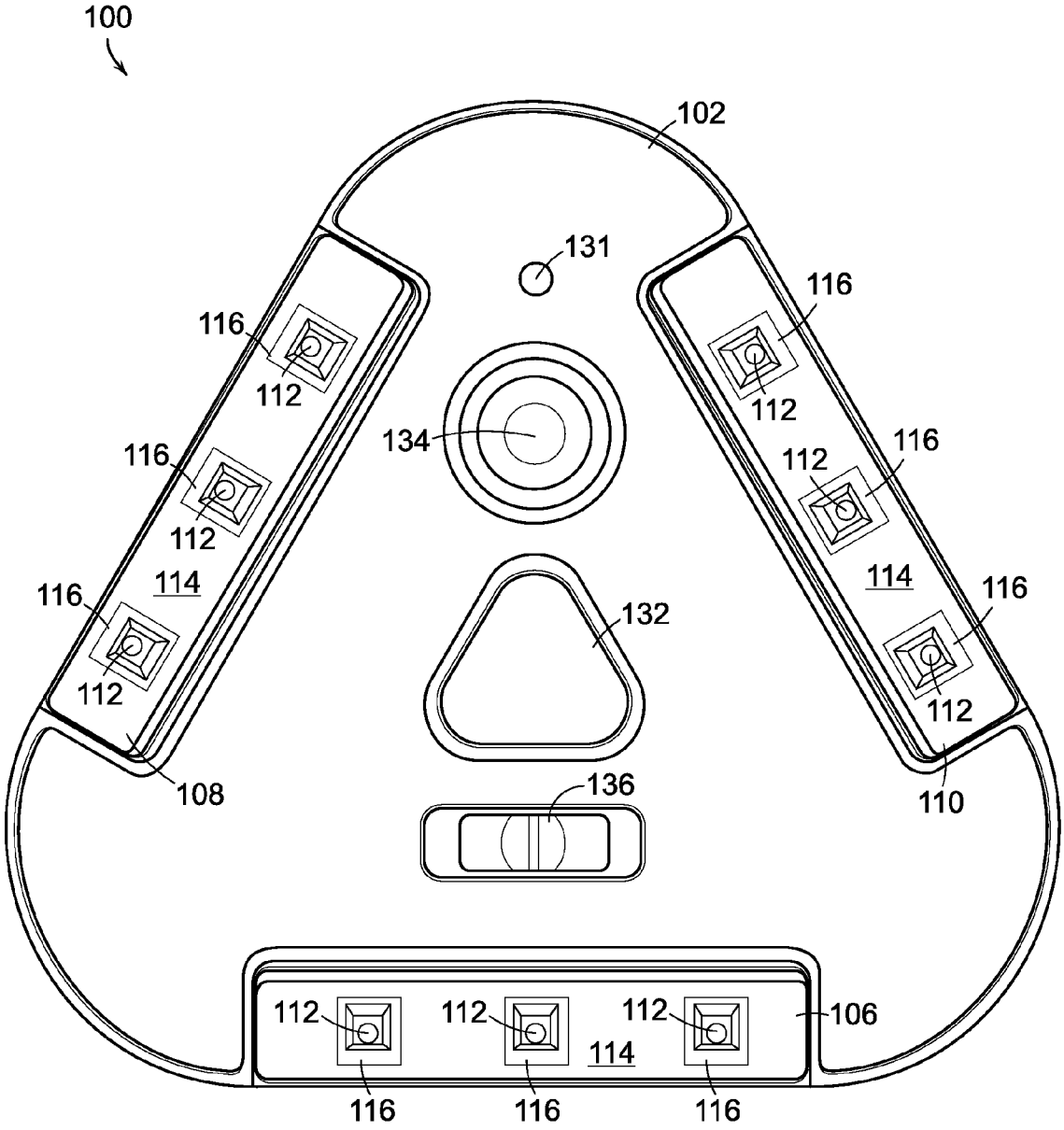
FIG. 7 is a top plan view of the lighting device of FIG. 1.
Figure 10:
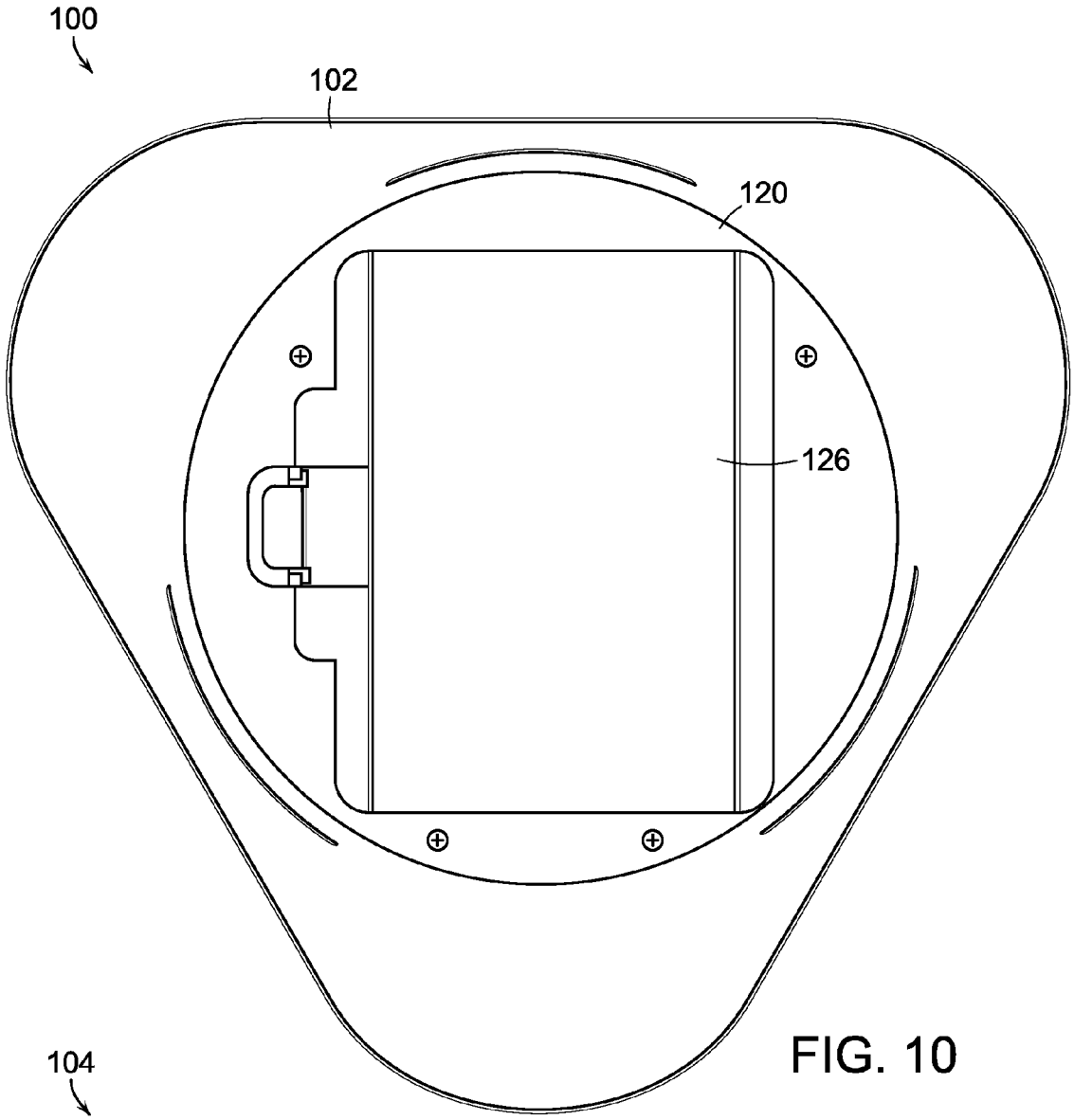
FIG. 10 is a bottom plan view of the lighting device of FIG. 1 with the mounting plate removed.
Figure 11:
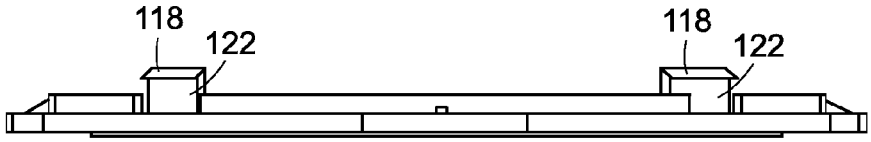
FIG. 11 is a side profile view of the mounting plate of the lighting device of FIG. 1.
Figure 12:
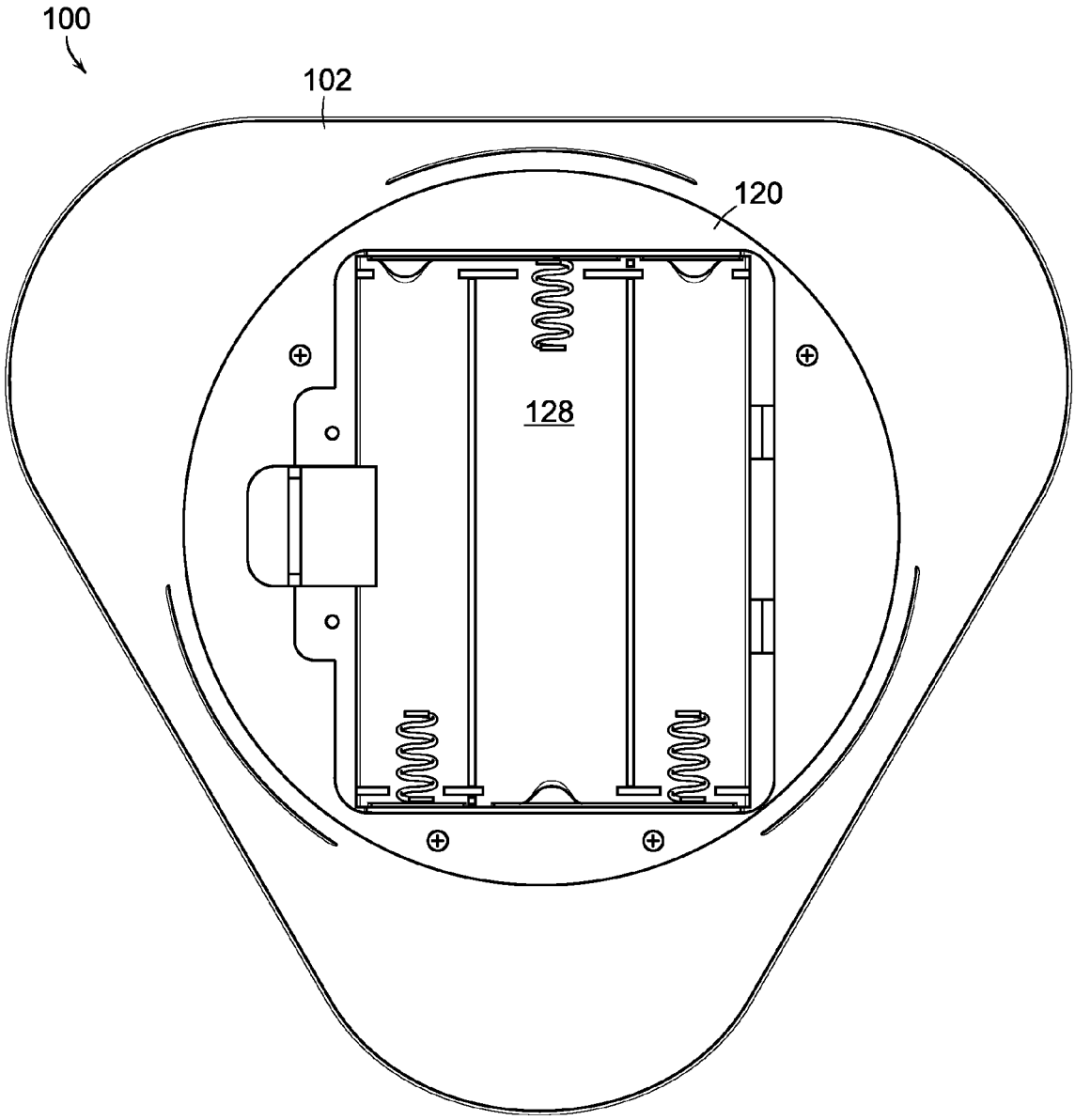
FIG. 12 is a bottom plan view of the lighting device of FIG. 1 with the mounting plate and the battery compartment cover removed.

FIGS. 2, 10 and 12 are plan views of the bottom surface of the lighting device 100. As shown in FIG. 2, the mounting plate 104 is attached to the bottom surface of the frame 102. FIG. 10 shows the bottom surface of the frame 102 with the mounting plate 104 removed. FIG. 11 is a side profile view of the mounting plate 104 separate from the frame 102. As shown in FIG. 11, the mounting plate 104 includes four guide clips 118 that extend vertically into a circular opening 120 in the bottom surface of the frame 102. Each guide clip 118 defines a groove 122 to engage, preferably in a loose, snap-fit manner, a rim of the circular opening 120 in the bottom surface of the frame 102. When the lighting device 100 is installed with the mounting plate 104 fixed, the remainder of the lighting device is free to rotate along the grooves 122. Specifically, the grooves 122 interact with the rim of the circular opening 120 in the frame 102 to guide, but not restrict, rotational movement of the frame along with the other components attached to the frame.

As shown in FIG. 2, the mounting plate 104 includes two mounting holes 124. The mounting holes 124 can receive the heads of screws or other fasteners attached to a mounting surface. Using the mounting holes 124, the mounting plate 104 can be permanently or removably installed on a cabinet, wall, or other surface. The remainder of the lighting device 100 then can be releasably clipped to the mounting plate 104 via the guide clips 118. Other embodiments can include a different number of mounting holes (e.g., one, three, or four) or a completely different mounting mechanism. Alternative mounting mechanisms can include, for example, adhesive material, magnetic material, or hook-and-loop material attached to the mounting plate. The mounting material (e.g., adhesive material, magnetic material, or hook-and-loop material) can be placed within a recessed portion of the mounting plate 104 so as to allow the lighting device to be mounted substantially flush with a mounting surface.

The mounting plate 104 can be separated from the frame 102 without the use of tools. As shown in FIG. 10, removal of the mounting plate 104 exposes a battery compartment cover 126. FIG. 12 shows the bottom surface of the frame 102 with both the mounting plate 104 and the battery compartment cover 126 removed to expose a battery compartment 128. A circuit board (not shown) is positioned within the frame 102 on the side of the battery compartment 128 opposite to the side covered by the battery compartment cover 126. In the illustrated lighting device 100, the battery compartment 128 is configured to hold three AA batteries positioned side-by-side. These batteries are electrically connected in series with soldered connections (not shown) at the beginning and end of the series. Wires (not shown) extending from the soldered connections provide power to the circuit board and the lighting elements 112.

In addition to or instead of using battery power, the lighting device 100 can use power drawn from a standard electrical receptacle connected via a DC port 130 located on a side surface of the frame 102. When the lighting device 100 begins receiving power via the DC port 130, power draw from batteries within the battery compartment 128 automatically ceases and an indicator light 131 on the top surface of the frame 102 illuminates. Some embodiments that can be connected to an external power source also include a power supply switch. When these embodiments are connected to an external power source, the power supply switch can be used to manually toggle power draw for the lighting elements between the batteries and the external power source. Other embodiments can include different power supply configurations. Embodiments powered exclusively or optionally by batteries can include any number, type and arrangement of batteries, such as two AAA batteries in parallel or one nine-volt battery directly connected to the circuit. Embodiments configured to receive power from an external power source can be, for example, hard wired to a wall circuit or connectable to a USB power source. If a DC adaptor is required, it can be embedded within the frame or included along a separate power cord.

The top surface of the frame 102 of the lighting device 100 includes a power button 132. When the power button 132 is pressed, it translates the action to activate a switch (not shown) on the circuit board. This turns the lighting elements 112 on or off or changes the level of light intensity. Specifically, in the lighting device 100, a first press of the power button 132 turns on the lighting elements 112, a second press of the power button decreases the light intensity, and a third press of the power button turns off the lighting elements. Alternative embodiments can include a power button configured to turn the lighting elements on or off only, to cycle the lighting elements through additional levels of light intensity, or to cycle between the activation of different numbers of lighting elements from among a plurality of lighting elements. For example, in alternative embodiments, a single press of the power button can turn on the lighting elements in the first light bar, a second press of the power button can turn on the lighting elements in the second light bar, a third press of the power button can turn on the lighting elements in the third light bar, and a fourth press of the power button can turn off all the lighting elements. The functionality of cycling the light intensity or the number of illuminated lighting elements is achieved, for example, by including a commercially available dimmer or selector switch on the circuit board. Instead of a power button, other embodiments can include another type of switch, such as a toggle switch, a rocker switch, a slide switch, or a dial. The power button or other switch type can be positioned, for example, on a portion of the lighting device other than the top surface of the frame.

The lighting device 100 includes a light sensor 134 that can activate and deactivate the lighting elements 112 when light from another source is detected. A slide switch 136 is positioned on the top surface of the frame 102 to change operation of the lighting device 100 between three modes involving the light sensor 134. When the slide switch 136 is in a first position, the light sensor 134 is off and the power button 132 solely controls operation of the lighting device 100. When the slide switch 136 is in a second position, the light sensor 134 is configured to activate the lighting device 100 when bright ambient light is detected. When the slide switch 136 is in a third position, the light sensor 134 is configured to activate the lighting device 100 when dim ambient light is detected. Other embodiments can include no sensor or an alternative sensor configuration. For example, some embodiments include a light sensor set to activate the lighting elements in response to the absence of light. Other embodiments can include another type of sensor, such as a motion sensor. Embodiments including a light sensor and a motion sensor can include a switch that allows the lighting elements to be activated in response to detected light (or lack of light) and/or motion.

Embodiments of the disclosed lighting device can include a variety of features in addition to or in place of those described above and shown in FIGS. 1-14. In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A lighting device, comprising:

a mounting plate;

a light bar frame, the mounting plate and the light bar frame having cooperable rotation elements that allow the light bar frame to rotate relative to the mounting plate around a first rotation axis;

a first light bar positioned within the light bar frame, the light bar frame and the first light bar having cooperable rotation elements that allow the first light bar to rotate relative to the light bar frame around a second rotation axis substantially perpendicular to the first rotation axis;

a second light bar positioned within the light bar frame, the light bar frame and the second light bar having cooperable rotation elements that allow the second light bar to rotate relative to the light bar frame around a third rotation axis substantially perpendicular to the first rotation axis; and a third light bar positioned within the light bar frame, the light bar frame and the third light bar having cooperable rotation elements that allow the third light bar to rotate relative to the light bar frame around a fourth rotation axis substantially perpendicular to the first rotation axis, wherein the second, third, and fourth rotation axes form three sides of a polygon.

2. The lighting device according to claim 1, wherein the mounting plate has a major surface configured to be attached to a substantially flat mounting surface, and the first rotation axis is substantially perpendicular to the major surface of the mounting plate.

3. The lighting device according to claim 1, wherein the first, second, and third light bars are elongated and the second, third, and fourth rotation axes are parallel to the lengths of the first, second, and third light bars; respectively.

4. The lighting device according to claim 1, wherein the first, second, and third light bars each include two or more light-emitting diodes.

5. The lighting device according to claim 1, wherein the polygon is a triangle.

6. The lighting device according to claim 1, wherein the mounting plate has a major surface configured to be attached to a substantially flat mounting surface, the second, third, and fourth rotation axes are substantially coplanar, and the second, third, and fourth rotation axes are substantially parallel to the major surface of the mounting plate.

7. The lighting device according to claim 1, further comprising a light sensor, a motion sensor, or both cooperable with the first, second, and third light bars to activate one or more lighting elements within the first, second, and third light bars.

8. The lighting device according to claim 1, further comprising a battery compartment positioned within the light bar frame.

9. The lighting device according to claim 8, wherein the light bar frame is separable from the mounting plate to access the battery compartment.

10. A lighting device, comprising:

a first rotatable light bar;

a second rotatable light bar;

a third rotatable light bar; and a battery compartment, wherein the lighting device has a major surface configured to be attached to a substantially flat mounting surface, the lighting device has a cross section in a plane substantially parallel to the major surface that is substantially shaped as a polygon, and the first, second, and third light bars are positioned along first, second, and third sides of the polygon, respectively.

11. The lighting device according to claim 10, wherein the first, second, and third light bars each extend over between about 40% and about 95% of the lengths of the first, second, and third sides of the polygon, respectively.

12. The lighting device according to claim 10, wherein the first, second, and third light bars each include two or more light-emitting diodes.

13. The lighting device according to claim 10, wherein the polygon is a triangle.

14. The lighting device according to claim 10 further comprising a mounting plate and a light bar frame, wherein the battery compartment and the first, second, and third light bars are positioned within the light bar frame, the mounting plate includes the major surface, and the mounting plate and the light bar frame have cooperable rotation elements that allow the light bar frame to rotate relative to the mounting plate around a first rotation axis.

15. The lighting device according to claim 14, wherein the first rotation axis is substantially perpendicular to the major surface.

16. The lighting device according to claim 14, wherein the light bar frame is separable from the mounting plate to access the battery compartment.

17. The lighting device according to claim 14, wherein the light bar frame and the first light bar have cooperable rotation elements that allow the first light bar to rotate relative to the light bar frame around a second rotation axis substantially perpendicular to the first rotation axis, the light bar frame and the second light bar have cooperable rotation elements that allow the second light bar to rotate relative to the light bar frame around a third rotation axis substantially perpendicular to the first rotation axis, and the light bar frame and the third light bar have cooperable rotation elements that allow the third light bar to rotate relative to the light bar frame around a fourth rotation axis substantially perpendicular to the first rotation axis.

18. The lighting device according to claim 17, wherein the first, second, and third light bars are elongated and the second, third, and fourth rotation axes are parallel to the lengths of the first, second, and third light bars, respectively.

19. The lighting device according to claim 17, wherein the second, third, and fourth rotation axes are substantially coplanar and the second, third, and fourth rotation axes are substantially parallel to the major surface.

20. A lighting device, comprising:

a frame;

means for allowing the frame to rotate relative to a mounting surface around a first rotation axis;

means for securing the frame to the mounting surface;

a first elongated light source housing positioned within the frame and rotatable relative to the frame around a second rotation axis substantially perpendicular to the first rotation axis;

a second elongated light source housing positioned within the frame and rotatable relative to the frame around a third rotation axis substantially perpendicular to the first rotation axis; and a third elongated light source housing positioned within the frame and rotatable relative to the frame around a fourth rotation axis substantially perpendicular to the first rotation axis, wherein the second, third, and fourth rotation axes form three sides of a polygon.

* * * * *